US012630273B2

(12) United States Patent
Lund

(10) Patent No.: US 12,630,273 B2
(45) Date of Patent: May 19, 2026

(54) PROCESSING CIRCUITRY CONFIGURED TO DETERMINE INFORMATION INDICATIVE OF A POSITION OF A TRANSLATIONAL MOVEMENT SENSOR ON A MARINE VESSEL

(71) Applicant: VOLVO PENTA CORPORATION, Gothenburg (SE)

(72) Inventor: Erik Lund, Mölndal (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 35 days.

(21) Appl. No.: 18/756,102

(22) Filed: Jun. 27, 2024

(65) Prior Publication Data

US 2025/0010962 A1 Jan. 9, 2025

(30) Foreign Application Priority Data

Jul. 3, 2023 (EP) ..... 23183094

(51) Int. Cl.
*B63H 21/21* (2006.01)
*B63B 79/10* (2020.01)

(52) U.S. Cl.
CPC ..... *B63B 79/10* (2020.01); *B63H 21/21* (2013.01); *B63H 2021/216* (2013.01)

(58) Field of Classification Search
None
See application file for complete search history.

(56) References Cited

U.S. PATENT DOCUMENTS 8,296,053 B1 * 10/2012 Brennan ..... F42B 15/01 244/3.28
11,675,372 B2 * 6/2023 Derginer ..... G05D 1/0875 701/21
2007/0146325 A1 * 6/2007 Poston ..... G06F 3/038 345/163
2019/0265350 A1 * 8/2019 Hawker ..... G01C 21/1652
2020/0140051 A1 * 5/2020 Derginer ..... G05D 1/0875
2021/0387706 A1 * 12/2021 Siganos ..... G06V 10/82
2024/0253752 A1 * 8/2024 Nakamura ..... B63B 79/40

FOREIGN PATENT DOCUMENTS

EP 3657198 A1 5/2020

OTHER PUBLICATIONS

Extended European Search Report in corresponding European Application No. 23183094.4 dated Dec. 8, 2023 (5 pages).

* cited by examiner

*Primary Examiner* — James M McPherson
(74) *Attorney, Agent, or Firm* — Jeffri A. Kaminski; Venable LLP

(57) ABSTRACT

A method for determining information indicative of a position of a translational movement sensor on a marine vessel is provided. The marine vessel extends in a longitudinal direction along a marine vessel longitudinal axis, the longitudinal direction preferably corresponds to an intended direction of travel of the marine vessel. The marine vessel extends in a vertical direction along a marine vessel vertical axis and in a transversal direction along a marine vessel transversal axis. The transversal axis is perpendicular to each one of the longitudinal axis and the vertical axis.

14 Claims, 7 Drawing Sheets

PROCESSING CIRCUITRY CONFIGURED TO DETERMINE INFORMATION INDICATIVE OF A POSITION OF A TRANSLATIONAL MOVEMENT SENSOR ON A MARINE VESSEL

TECHNICAL FIELD

The disclosure relates generally to a computer system comprising a processing circuitry. In particular aspects, the disclosure relates to a computer system comprising a processing circuitry configured to determine information indicative of a position of a translational movement sensor on a marine vessel. The disclosure can be applied to marine vessels such as ships, boats, barges etcetera. Although the disclosure may be described with respect to a particular marine vessel, the disclosure is not restricted to any particular marine vessel.

BACKGROUND

A marine vessel may comprise one or more translational movement sensors. Purely by way of example, a marine vessel may comprise a translational movement sensor for determining a position of a portion of the marine vessel. As another non-limiting example, a marine vessel may comprise a translational movement sensor for determining a translational velocity and/or a translational acceleration of a portion of the marine vessel. However, the accuracy of the measurements of a translational movement sensor hosted by a marine vessel may be dependent on the position of translational movement sensor in relation to the marine vessel.

SUMMARY

According to a first aspect of the disclosure, there is provided a computer system comprising a processing circuitry configured to determine information indicative of a position of a translational movement sensor on a marine vessel, the marine vessel extending in a longitudinal direction along a marine vessel longitudinal axis, the longitudinal direction preferably corresponding to an intended direction of travel of the marine vessel, the marine vessel extending in a vertical direction along a marine vessel vertical axis and in a transversal direction along a marine vessel transversal axis, wherein the transversal axis is perpendicular to each one of the longitudinal axis and the vertical axis, the computer system being adapted to:

- receive a time-varying rotational movement signal from a rotational movement sensor of the marine vessel, the time-varying rotational movement signal relating to a rotational movement of the marine vessel around a first reference axis as a function of time for a first time range;
- receive a time-varying translational movement signal from the translational movement sensor, the time-varying rotational movement signal relating to a translational movement of the translational movement sensor along a second reference axis as a function of time for a second time range, the first reference axis being nonparallel to the second reference axis;
- use the time-varying rotational movement signal for determining reference frequency rotational movement information indicative of the rotational movement of the marine vessel around the first reference axis for a reference frequency;

- use the time-varying translational movement signal for determining reference frequency translational movement information indicative of the translational movement of the translational movement sensor along the second reference axis for the reference frequency;
- use the reference frequency rotational movement information and the reference frequency translational movement information for determining the information indicative of the position of the translational movement sensor on the marine vessel.

The first aspect of the disclosure may seek to solve the problem associated with uncertainties as regards the location of a translational movement sensor on a marine vessel. Such uncertainties may result in inaccurate results from a translational movement sensor that is hosted by the marine vessel. A technical benefit may include that appropriate information as regards the location of the translational movement sensor may be obtained without necessarily requiring dedicated measuring devices or the like.

According to a second aspect of the disclosure, there is provided a computer-implemented method for determining information indicative of a position of a translational movement sensor on a marine vessel by a processing circuitry of a computer system, the marine vessel extending in a longitudinal direction along a marine vessel longitudinal axis, the longitudinal direction preferably corresponding to an intended direction of travel of the marine vessel, the marine vessel extending in a vertical direction along a marine vessel vertical axis and in a transversal direction along a marine vessel transversal axis, wherein the transversal axis is perpendicular to each one of the longitudinal axis and the vertical axis, the method comprising:

- receiving, by the processing circuitry, a time-varying rotational movement signal from a rotational movement sensor of the marine vessel, the time-varying rotational movement signal relating to a rotational movement of the marine vessel around a first reference axis as a function of time for a first time range;
- receiving, by the processing circuitry, a time-varying translational movement signal from the translational movement sensor, the time-varying rotational movement signal relating to a translational movement of the translational movement sensor along a second reference axis as a function of time for a second time range, the first reference axis being nonparallel to the second reference axis;
- using, by the processing circuitry, the time-varying rotational movement signal for determining reference frequency rotational movement information indicative of the rotational movement of the marine vessel around the first reference axis for a reference frequency;
- using, by the processing circuitry, the time-varying translational movement signal for determining reference frequency translational movement information indicative of the translational movement of the translational movement sensor along the second reference axis for the reference frequency;
- using, by the processing circuitry, the reference frequency rotational movement information and the reference frequency translational movement information for determining the information indicative of the position of the translational movement sensor on the marine vessel.

The second aspect of the disclosure may seek to solve the problem associated with uncertainties as regards the location of a translational movement sensor on a marine vessel. Such uncertainties may result in inaccurate results from a translational movement sensor that is hosted by the marine vessel. A technical benefit may include that appropriate information as regards the location of the translational movement sensor may be obtained without necessarily requiring dedicated measuring devices or the like.

Optionally in some examples, including in at least one preferred example, the second reference axis is fixed in a global reference coordinate system, the global reference coordinate system comprising a global longitudinal axis, a global transversal axis and a global vertical axis, the global reference coordinate system being such that when the marine vessel floats at calm sea with zero trim and tilt, the global vertical axis is parallel to the marine vessel vertical axis, the global reference coordinate system being fixed to an entity separate from the marine vessel, preferably the global reference coordinate system being earth fixed. A technical benefit may include a versatility in possible detected movements of the marine vessel. For instance, if the translational movement sensor is a sensor detecting a position in the global reference coordinate system, such as a GPS or the like, the above examples may provide appropriate results.

Optionally in some examples, including in at least one preferred example, using the time-varying rotational movement signal for determining reference frequency rotational movement information indicative of the rotational movement of the marine vessel around the first reference axis for a reference frequency comprises transferring the time-varying rotational movement signal to the frequency domain in order to obtain frequency dependent rotational movement information. A technical benefit may include that motion characteristics of the rotational movement of the marine vessel around the first reference axis may be determined in a straightforward way.

Optionally in some examples, including in at least one preferred example, using the time-varying translational movement signal for determining reference frequency translational movement information indicative of the translational movement of the translational movement sensor along the second reference axis for the reference frequency comprising transferring the time-varying rotational movement signal to the frequency domain in order to obtain frequency dependent translational movement information. A technical benefit may include that the frequency dependent translational movement information may be straightforward to use in conjunction with e.g. the frequency dependent rotational movement information.

Optionally in some examples, including in at least one preferred example, the second reference axis is perpendicular to the first reference axis. A technical benefit may include that appropriate information as regards the position of a translational movement sensor may be determined.

Optionally in some examples, including in at least one preferred example, the first reference axis is perpendicular to the marine vessel vertical axis.

Optionally in some examples, including in at least one preferred example, the method further comprises determining a vertical position along the marine vessel vertical axis of the translational movement sensor using the time-varying rotational movement signal and the time-varying translational movement signal. A technical benefit may include that the vertical position may be determined in a straightforward manner. The vertical position thus determined may for instance be used for calibrating information issued from the translational movement sensor.

Optionally in some examples, including in at least one preferred example, the method further comprises determining the vertical position along the marine vessel vertical axis of the translational movement sensor using the frequency dependent rotational movement information and the frequency dependent translational movement information. A technical benefit may include that the vertical position may be determined in a straightforward way since the use of the frequency dependent rotational movement information and the frequency dependent translational movement information implies that relatively compact information may be used wherein such information also may be less sensitive to disturbances or the like in the time-varying signals.

Optionally in some examples, including in at least one preferred example, the frequency dependent rotational movement information comprises a set of rotational movement amplitudes, each rotational movement amplitude being associated with an individual frequency, the method comprising determining a reference frequency associated with the largest rotational movement amplitude in the set of rotational movement amplitudes and to determine a translational movement amplitude for the reference frequency using the frequency dependent translational movement information. A technical benefit may include that for reference frequency associated with the largest rotational movement amplitude, the rotational movement may be the main contributor to the translational movement of the sensor. As such, the examples above implies in appropriate accuracy in the determination of the information indicative of a position of a translational movement sensor on a marine vessel.

Optionally in some examples, including in at least one preferred example, the first reference axis is parallel to the marine vessel vertical axis. A technical benefit may include that a horizontal position of the translational movement sensor may be determined in a straightforward way.

Optionally in some examples, including in at least one preferred example, the time-varying rotational movement signal comprises information about a rotation rate of the rotational movement of the marine vessel around the first reference axis of the marine vessel.

Optionally in some examples, including in at least one preferred example, the time-varying translational movement signal comprises information about velocity along the second reference axis, preferably the second reference axis being parallel to the global longitudinal axis or to the global transversal axis.

Optionally in some examples, including in at least one preferred example, the method further comprises determining a transversal position along the marine vessel transversal axis and/or a longitudinal position along the marine vessel longitudinal axis of the translational movement sensor using the time-varying rotational movement signal and the time-varying translational movement signal.

Optionally in some examples, including in at least one preferred example, the method further comprising determining the transversal position along the marine vessel transversal axis and/or a longitudinal position along the marine vessel longitudinal axis of the translational movement sensor using the frequency dependent rotational movement information and the frequency dependent translational movement information. A technical benefit may include that the transversal and/or longitudinal position may be determined in a straightforward way since the use of the frequency dependent rotational movement information and the frequency dependent translational movement information implies that relatively compact information may be used wherein such information also may be less sensitive to disturbances or the like in the time-varying signals.

Optionally in some examples, including in at least one preferred example, the frequency dependent rotational movement information comprises a set of rotation rate amplitudes, each rotation rate amplitude being associated with an individual frequency, the method comprising determining a reference frequency associated with the largest rotation rate amplitude in the set of rotation rate amplitudes and to determine an amplitude for the velocity along the second reference axis for the reference frequency using the frequency dependent translational movement information. A technical benefit may include that for reference frequency associated with the largest rotation rate amplitude, the rotational movement may be the main contributor to the movement of the sensor. As such, the examples above implies in appropriate accuracy in the determination of the information indicative of a position of a translational movement sensor on a marine vessel.

Optionally in some examples, including in at least one preferred example, the marine vessel has a propulsion system, the method further comprising issuing a signal to the propulsion system of the marine vessel to perform a rotational movement. A technical benefit may include that the rotational movement may be imparted the marine vessel in a straightforward manner.

Optionally in some examples, including in at least one preferred example, the first time range is adjacent to or at least partially overlaps said second time range.

As used herein, the expression that the first time range is "adjacent to" the second time range is intended to encompass that a smallest temporal distance from an end point of the first time range and an end point of the second time range is less than the largest of the temporal extension of the first time range and the second time range. As an example, if the first time range has a temporal extension of 50 second and the second time range has a temporal extension of 70 seconds, the first time range is "adjacent to" the second time range if the a smallest temporal distance from an end point of the first time range and an end point of the second time range is less than 70 seconds.

According to a third aspect of the disclosure, there is provided a computer program product comprising program code for performing, when executed by the processing circuitry, a method of the second aspect of the disclosure. The third aspect of the disclosure may seek to determine information indicative of a position of a translational movement sensor on a marine vessel. A technical benefit may include that such a position may be determined in a straightforward manner without necessarily requiring dedicated measuring devices or the like.

According to a fourth aspect of the disclosure, there is provided a non-transitory computer-readable storage medium comprising instructions, which when executed by the processing circuitry, cause the processing circuitry to perform a method of the second aspect of the disclosure. The fourth aspect of the disclosure may seek to determine information indicative of a position of a translational movement sensor on a marine vessel. A technical benefit may include that such a position may be determined in a straightforward manner without necessarily requiring dedicated measuring devices or the like.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

Figure 1:
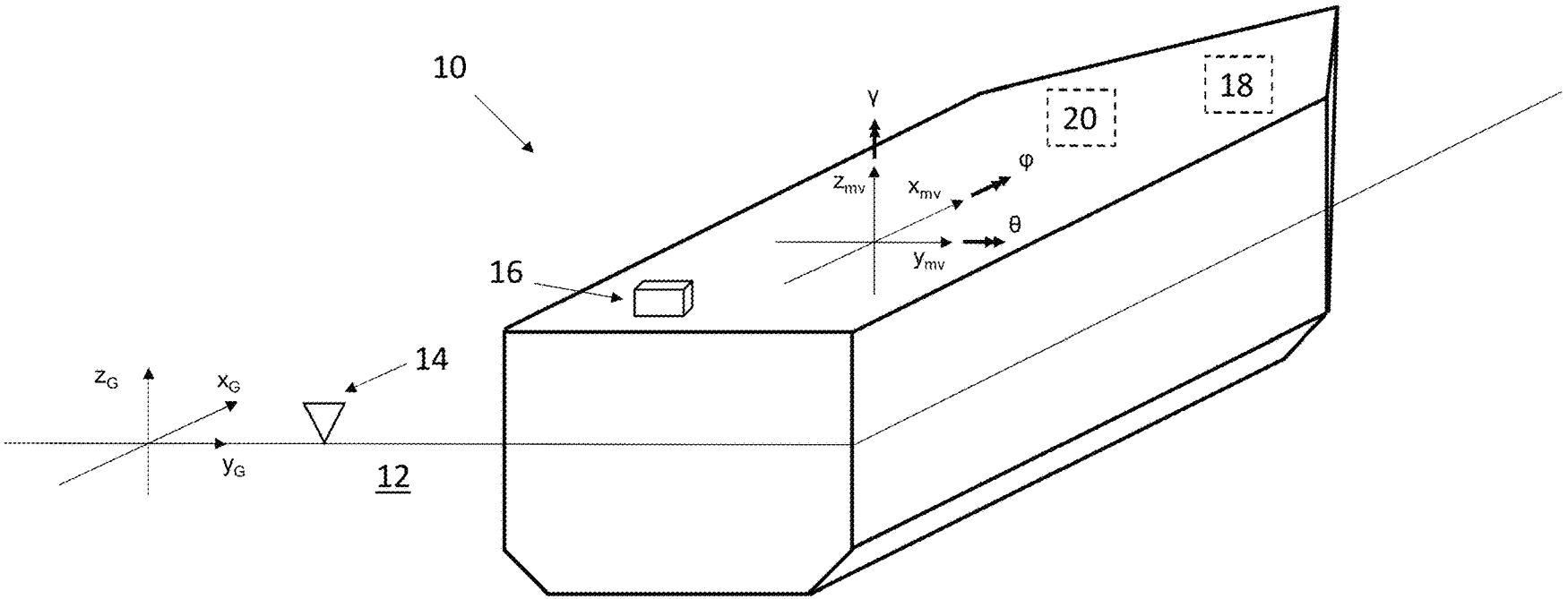
FIG. 1 is an exemplary perspective view of a marine vessel.

FIG. 1 is an exemplary schematic marine vessel 10. The FIG. 1 marine vessel 10 is exemplified as a boat. However, the marine vessel 10 may also be a ship, a semisubmersible unit, a submarine or the like. As indicated in FIG. 1, the marine vessel 10 floats in a body of water 12 having a still water surface 14. Moreover, as indicated in FIG. 1, the marine vessel 10 extends in a longitudinal direction along a marine vessel longitudinal axis $x_{mv}$. The longitudinal direction preferably corresponds to an intended direction of travel of the marine vessel 10. The marine vessel extends 10 in a vertical direction along a marine vessel vertical axis $z_{mv}$ and in a transversal direction along a marine vessel transversal axis $y_{mv}$. When the marine vessel 10 floats in the body of water 12 with the still water surface 14, the marine vessel vertical axis $z_{mv}$ is parallel to a normal of a plane extending in the still water surface 14. The transversal axis $y_{mv}$ is perpendicular to each one of the longitudinal axis $x_{mv}$ and the vertical axis $z_{mv}$.

FIG. 1 also, by means of double arrows, illustrates the rotation around each one of the axes $x_{mv}$, $y_{mv}$ and $z_{mv}$ mentioned hereinabove. To this end, rotation around the marine vessel longitudinal axis $x_{mv}$ may be referred to as roll $\varphi$, rotation around the marine vessel transversal axis $y_{mv}$ may be referred to as pitch $\theta$ and rotation around the marine vessel vertical axis $z_{mv}$ may be referred to as yaw $\gamma$. Furthermore, a translational movement along the marine vessel longitudinal axis $x_{mv}$ may be referred to as surge, a translational movement along the marine vessel transversal axis $y_{mv}$ may be referred to as sway and a translational movement along the marine vessel vertical axis $V_{mv}$ may be referred to as heave.

Moreover, FIG. 1 illustrates that the marine vessel 10 may comprise a translational movement sensor 16 on a marine vessel 10. Purely by way of example, the translational movement sensor 16 may be adapted to determine a position of the sensor 16. As a non-limiting example, the translational movement sensor 16 may comprise a GPS or the like. Instead of, or in addition to, determining the position of the sensor 16, the translational movement sensor 16 may be adapted to determine the speed and/or acceleration of the sensor 16.

When the marine vessel 10 moves in the body of water 12, in particular when the marine vessel 10 is imparted environmental loads such as waves (not shown), dynamic wind etcetera, the marine vessel 10 will generally experience translational movements in each one of the three axes $x_{mv}$, $y_{mv}$ and $z_{mv}$ as well as rotational movements around each one of the of the three axes $x_{mv}$, $y_{mv}$ and $z_{mv}$. Since the marine vessel 10 generally moves as a rigid body, a translational movement of a point of the marine vessel 10 may be dependent of the rotational movements around one or more of the three axes $x_{mv}$, $y_{mv}$ and $z_{mv}$ as well as the distance from the point to the centre of rotation around one or more of the three axes $x_{mv}$, $y_{mv}$ and $z_{mv}$. Thus, for a translational movement sensor 16, the accuracy of the translational movements detected by the sensor 16 may be dependent on the location of the translational movement sensor 16 in relation to the marine vessel 10. As such, it would be desired to determine the above-mentioned position of the translational movement sensor 16 in a straightforward manner.

To this end, according to a first aspect of the disclosure, again with reference to FIG. 1, there is provided a computer system 18 comprising a processing circuitry configured to determine information indicative of a position of a translational movement sensor 16 on a marine vessel 10. The computer system 18 is adapted to receive a time-varying rotational movement signal from a rotational movement sensor 20 of the marine vessel 10. Purely by way of example, and as indicated in FIG. 1, the rotational movement sensor 20 may be separate from the translational movement sensor 16. However, it is also envisaged that the rotational movement sensor 20 and the translational movement sensor 16 may form a unitary component. As a non-limiting example, the rotational movement sensor 20 may comprise or even be constituted by an inclination sensor and/or a heading sensor. In some examples, the translational movement sensor 16 and/or the rotational movement sensor 20 may be in the form of a sensing unit comprising more than one sensor. Purely by way of example, the sensing unit may comprise an accelerometer and a gyro sensor, which are adapted to together provide information about the rotational movements of the marine vessel 10.

Irrespective of the implementation of the rotational movement sensor 20, the time-varying rotational movement signal relates to a rotational movement of the marine vessel around a first reference axis as a function of time for a first time range.

Moreover, again irrespective of the implementations of the translational movement sensor 16 and the rotational movement sensor 20, respectively, the computer system 18 is generally adapted to receive information from each one of the two sensors 16, 20. Purely by way of example, the computer system 18 may be in communication with each one of the two sensors 16, 20 via wire based and/or wire free communication units (not shown).

Moreover, the computer system 18 is adapted to receive a time-varying translational movement signal from the translational movement sensor 16. The time-varying rotational movement signal relates to a translational movement of the translational movement sensor 16 along a second reference axis as a function of time for a second time range. The first reference axis is nonparallel to the second reference axis.

Additionally, the computer system 18 is adapted to use the time-varying rotational movement signal for determining reference frequency rotational movement information indicative of the rotational movement of the marine vessel around the first reference axis for a reference frequency. Moreover, the computer system 18 is adapted to use the time-varying translational movement signal for determining reference frequency translational movement information indicative of the translational movement of the translational movement sensor 16 along the second reference axis for the reference frequency.

Furthermore, the computer system 18 is adapted to use the reference frequency rotational movement information and the reference frequency translational movement information for determining the information indicative of the position of the translational movement sensor 16 on the marine vessel 10.

According to a second aspect of the disclosure, there is provided a computer-implemented method for determining information indicative of a position of a translational movement sensor 16 on a marine vessel 10 by a processing circuitry of a computer system. As a non-limiting example, the processing circuitry may comprise of even be constituted by the computer system 18 mentioned hereinabove.

The Method Comprises:

- receiving, by the processing circuitry, a time-varying rotational movement signal from a rotational movement sensor 20 of the marine vessel 10, the time-varying rotational movement signal relating to a rotational movement of the marine vessel 10 around a first reference axis as a function of time for a first time range;
- receiving, by the processing circuitry, a time-varying translational movement signal from the translational movement sensor 16, the time-varying rotational movement signal relating to a translational movement of the translational movement sensor 16 along a second reference axis as a function of time for a second time range, the first reference axis being nonparallel to the second reference axis;
- using, by the processing circuitry, the time-varying rotational movement signal for determining reference frequency rotational movement information indicative of the rotational movement of the marine vessel 10 around the first reference axis for a reference frequency;
- using, by the processing circuitry, the time-varying translational movement signal for determining reference frequency translational movement information indicative of the translational movement of the translational movement sensor 16 along the second reference axis for the reference frequency;
- using, by the processing circuitry, the reference frequency rotational movement information and the reference frequency translational movement information for determining the information indicative of a position of a translational movement sensor on a marine vessel.

Examples of the above method will be presented below. Here, it should be noted that the below examples are equally applicable to the computer system 18 according to the first aspect of the present disclosure.

Optionally, in some examples, including in at least one preferred example, as indicated in FIG. 1 and as will be elaborated on further hereinbelow, the second reference axis may be fixed in a global reference coordinate system. As indicated in FIG. 1, the global reference coordinate system comprises a global longitudinal axis $x_G$, a global transversal axis $y_G$ and a global vertical axis $z_G$. The global reference coordinate system is such that when the marine vessel 10 floats at calm sea with zero trim and tilt, the global vertical axis $z_G$ is parallel to the marine vessel vertical axis $z_{mv}$. The global reference coordinate system is fixed to an entity separate from the marine vessel 10, preferably the global reference coordinate system is earth fixed.

Figure 2A:
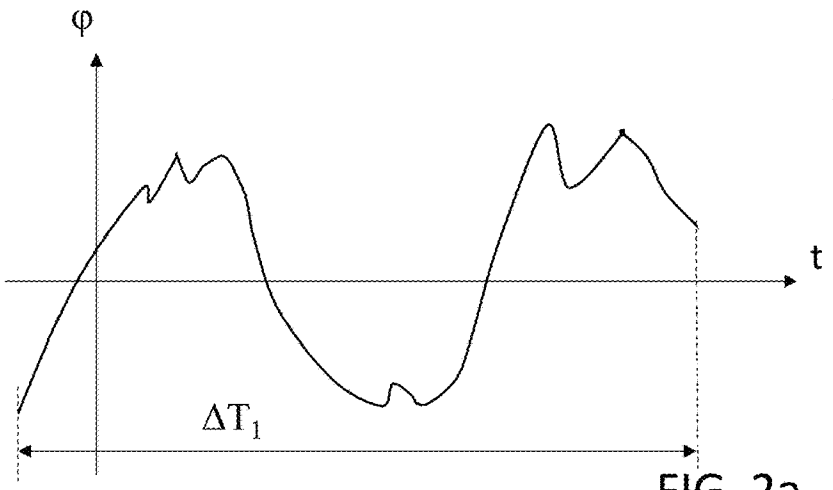
FIGS. 2*a*-2*d* illustrate time-varying movement signals and reference frequency information according to an example.

FIG. 2*a* illustrates a graph representing a time-varying rotational movement signal from a rotational movement sensor 20 of the marine vessel 10. As indicated above, the time-varying rotational movement signal relates to a rotational movement of the marine vessel 10 around a first reference axis, which first reference axis for instance may be fixed to the marine vessel 10, as a function of time for a first time range $\Delta T_1$. In the example in FIG. 2*a*, the rotational movement of the marine vessel 10 is exemplified as a as roll $\varphi$ motion. However, it is envisaged that the rotational movement may be any type of rotational movement in other examples of the disclosure.

Figure 2B:
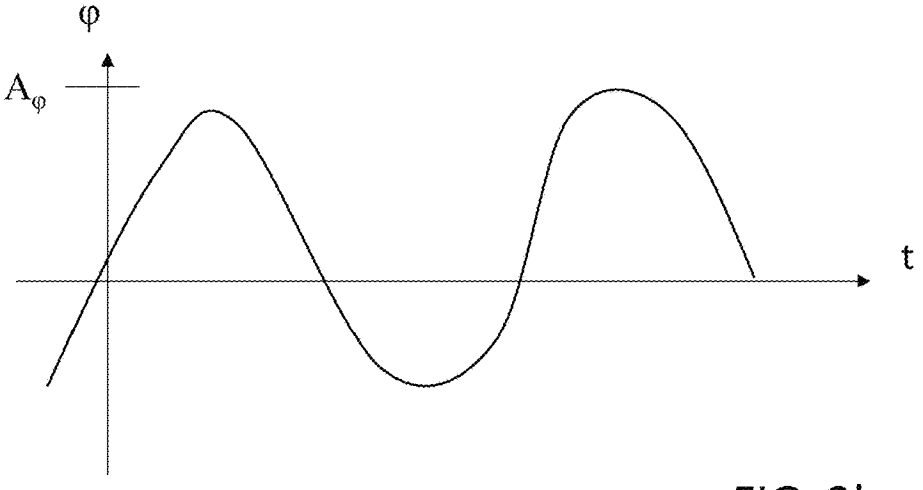
Figure 2C:
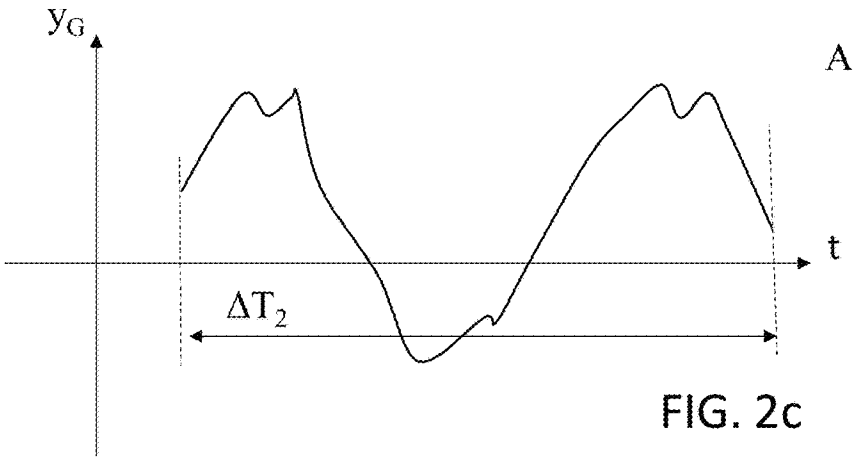

Moreover, FIG. 2*c* illustrates a time-varying translational movement signal from the translational movement sensor 16. The time-varying rotational movement signal relates to a translational movement of the translational movement sensor 16 along a second reference axis as a function of time for a second time range $\Delta T_2$. As indicated above, the first reference axis is nonparallel to the second reference axis. In the example in FIG. 2*c*, the translational movement of the translational movement sensor 16 is exemplified as a displacement along the global transversal axis $y_G$. Moreover, as may be realized when comparing FIG. 2*a* and FIG. 2*c*, the first time range $\Delta T_1$ may for example least partially overlap the second time range $\Delta T_2$. As such, there are one or more times instances, each one of which occurring within each one of the first time range $\Delta T_1$ and the second time range $\Delta T_2$.

The above-mentioned partial overlap may be achieved in a plurality of ways. For instance, the first time range $\Delta T_1$ may be located completely within the second time range $\Delta T_2$ or vice versa. Moreover, the first time range $\Delta T_1$ may be identical to the second time range $\Delta T_2$. As other examples, the start point for each one of the first time range $\Delta T_1$ and the second time range $\Delta T_2$ may be the same but their end points may differ. Conversely, the start point for each one of the first time range $\Delta T_1$ and the second time range $\Delta T_2$ may differ but their end points may be the same.

In some examples, the time-varying rotational movement signal from the rotational movement sensor 20 is highly similar to the time-varying translational movement signal from the translational movement sensor 16 within a defined time. In these examples, irrespective of whether the first time range $\Delta T_1$ partially overlaps with the second time range $\Delta T_2$ or not, the time-varying rotational movement signal from the rotational movement sensor 20 and the time-varying translational movement signal from the translational movement sensor 16 will be used to determine the information indicative of a position of a translational movement sensor on a marine vessel 10.

As another non-limiting example, the first time range $\Delta T_1$ may be adjacent to the second time range $\Delta T_2$. As used herein, the expression that the first time range $\Delta T_1$ is "adjacent to" the second time range $\Delta T_2$ is intended to encompass that a smallest temporal distance from an end point of the first time range and an end point of the second time range is less than the largest of the temporal extension of the first time range and the second time range. As an example, assume that the first time range $\Delta T_1$ is t=[0 s; 50 s] and that the second time range $\Delta T_2$ is t=[120 s; 200 s]. This means that the smallest temporal distance from an end point of the first time range $\Delta T_1$ and an end point of the second time range $\Delta T_2$ is the distance from the last time instant of the first time range $\Delta T_1$ to the first time instant of the second time range $\Delta T_2$ and that this distance in the above example is 70 (i.e. 120−50) seconds. Moreover, the temporal extension of the first time range $\Delta T_1$ is 50 seconds and the temporal extension of the second time range $\Delta T_2$ is 80 seconds, resulting in that the largest temporal extension of the first time range and the second time range is 80 seconds. Using the above definition of "adjacent to", the first time range $\Delta T_1$ is deemed to be "adjacent to" the second time range $\Delta T_2$ since the smallest temporal distance is 70 seconds which is less than 80 seconds.

FIG. 2*b* illustrates frequency rotational movement information indicative of the rotational movement of the marine vessel 10 around the first reference axis for a reference frequency. In the FIG. 2*b* example, the frequency rotational movement information has been obtained by filtering the FIG. 2*a* time-varying rotational movement signal such that only motions relating to the reference frequency remain after the filtering. As indicated in FIG. 2*b*, the reference frequency rotational movement information may for instance be used for determining an amplitude $A_\varphi$ which in FIG. 2*b* is exemplified as a roll amplitude.

Figure 2D:
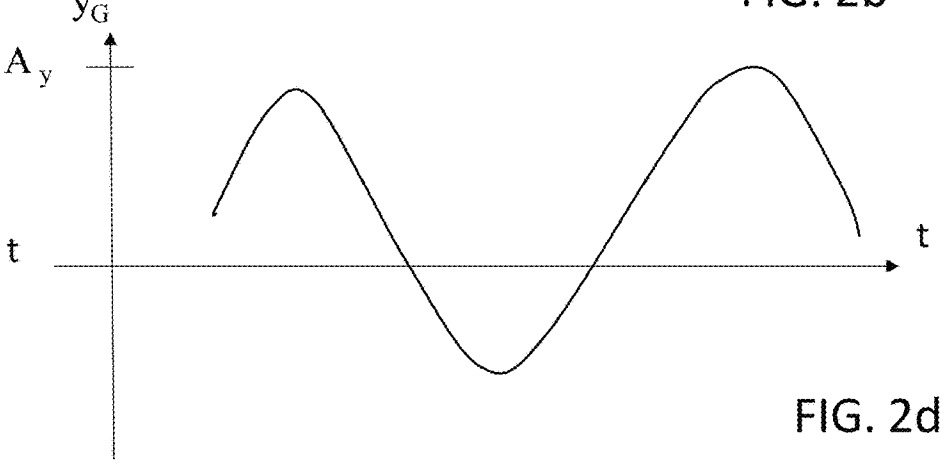

In a similar vein, FIG. 2*d* illustrates reference frequency translational movement information indicative of the translational movement of the translational movement sensor 16 along the second reference axis for the reference frequency. In the FIG. 2*d* example, the frequency translational movement information has been obtained by filtering the FIG. 2*c* time-varying translational movement signal such that only motions relating to the reference frequency remain after the filtering. As indicated in FIG. 2*d*, the reference frequency translational movement information may for instance be used for determining an amplitude $A_y$ which in FIG. 2*d* is exemplified as an amplitude of a displacement along the global transversal axis $y_G$.

It should be noted that the filtering alternative presented above paragraphs merely serves as examples of how the reference frequency rotational movement information and the reference frequency translational movement information, respectively, may be determined.

To this end, with references to FIG. 3*a*-FIG. 3*d*, in some examples, including in at least one preferred example, the use of the time-varying rotational movement signal for determining reference frequency rotational movement information indicative of the rotational movement of the marine vessel around the first reference axis for a reference frequency may comprises transferring the time-varying rotational movement signal to the frequency domain in order to obtain frequency dependent rotational movement information.

Figure 3A:
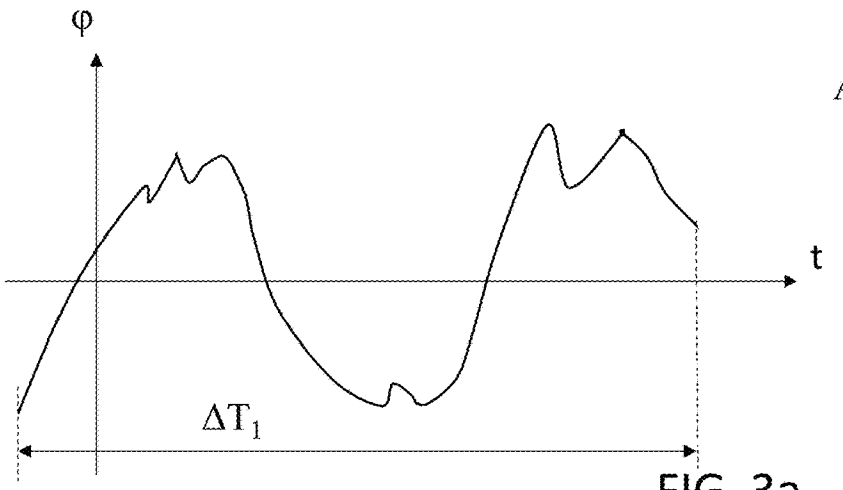
FIGS. 3*a*-3*d* illustrate time-varying movement signals and reference frequency information according to an example.
Figure 3B:
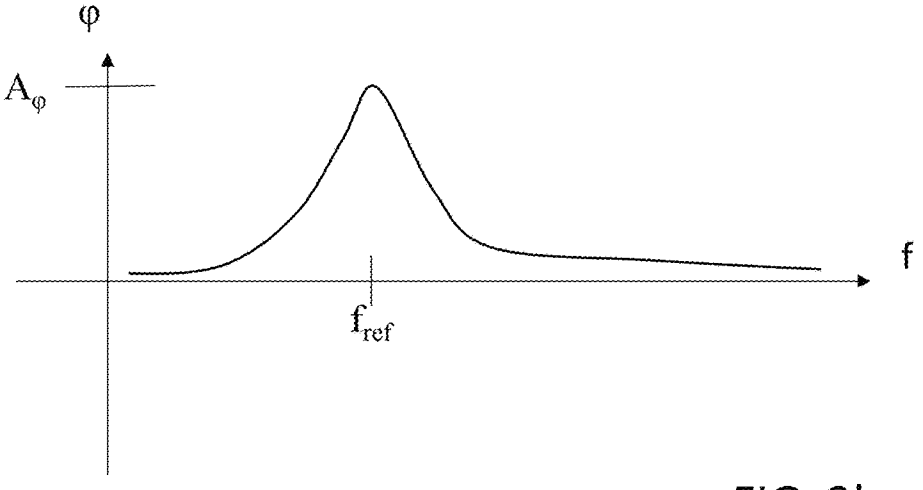
Figure 3C:
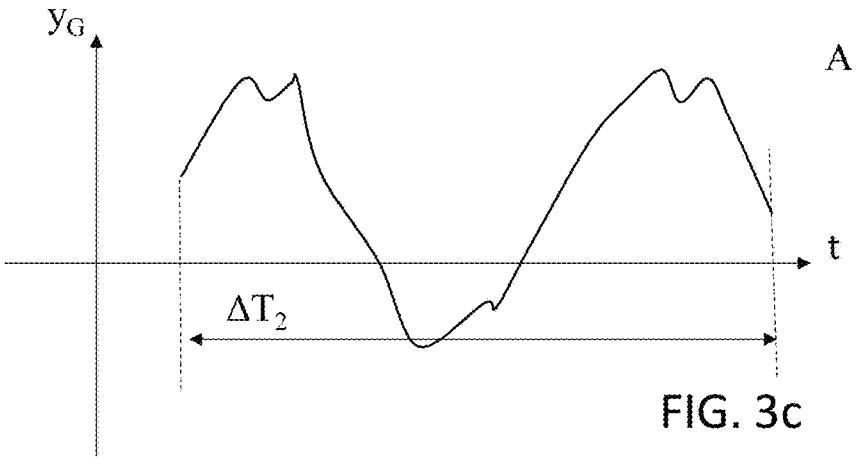

As may be realized from FIG. 3*a* and FIG. 3*c*, FIG. 3*a* illustrates a time-varying rotational movement signal from a rotational movement sensor 20 of the marine vessel 10 and the FIG. 3*a* graph is identical to the FIG. 2*a* graph. Moreover, as indicated in FIG. 3*a*, the abscissa in the FIG. 3*a* graph has the entity time. FIG. 3*c* illustrates frequency dependent rotational movement information that has been obtained by transferring the time-varying rotational movement signal to the frequency domain. As a non-limiting example, such a transformation may be carried out using e.g. a Fourier transform such as a fast Fourier transform (FFT). As may be gleaned from FIG. 3*b*, the abscissa in the FIG. 3*b* graph has the entity frequency. Generally, transferring a time-varying signal to the frequency domain results in an amplitude and a phase for each frequency. However, in the FIG. 3*b* graph, only the amplitude as a function of frequency is illustrated. As may be realized from FIG. 3*b*, transferring the time-varying rotational movement signal to the frequency domain makes it possible to determine the amplitude for each one of a plurality of frequencies. In a similar vein as for FIG. 3*a* and FIG. 3*b*, FIG. 3*d* illustrates frequency translational movement information that has been obtained by transferring the time-varying translational movement signal in the FIG. 3*b* graph to the frequency domain.

As such, as illustrated in FIG. 3*b*, the frequency dependent rotational movement information may comprise a set of rotational movement amplitudes, each rotational movement amplitude being associated with an individual frequency. Moreover, the method of the present disclosure may comprise determining a reference frequency $f_{ref}$ associated with the largest rotational movement amplitude in the set of rotational movement amplitudes and determining a rotational movement amplitude $A_\varphi$ (see FIG. 3*b*) for the reference frequency $f_{ref}$ using the frequency dependent rotational movement information.

Figure 3D:
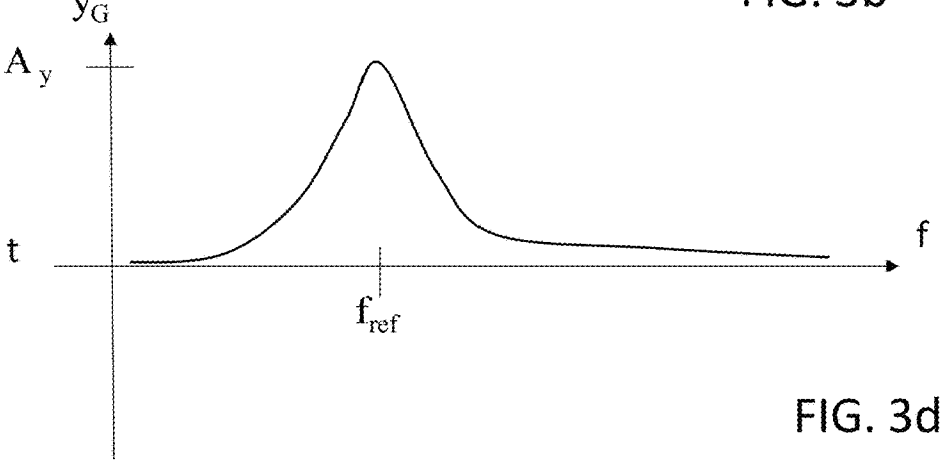

Furthermore, as illustrated in FIG. 3*d*, using the time-varying translational movement signal (see FIG. 3*b*) for determining reference frequency translational movement information indicative of the translational movement of the translational movement sensor 16 along the second reference axis for the reference frequency may comprise transferring the time-varying rotational movement signal to the frequency domain (see FIG. 3*d*) in order to obtain frequency dependent translational movement information. Moreover, as indicated in FIG. 3*d*, the frequency dependent translational movement information presented therein may be used for determining e.g. an amplitude $A_y$ for the reference frequency $f_{ref}$ associated with the largest rotational movement amplitude in the set of rotational movement amplitudes as presented hereinabove with reference to FIG. 3*b*.

It should be noted that any one of the above examples relating to any of the time-varying rotational movement signal, the time-varying translational movement signal, the frequency rotational movement information and the frequency translational movement information may be used in any example of the present disclosure, in particular in any example presented hereinbelow.

As regards the first and second reference axes, the second reference axis may be perpendicular to the first reference axis.

Figure 4:
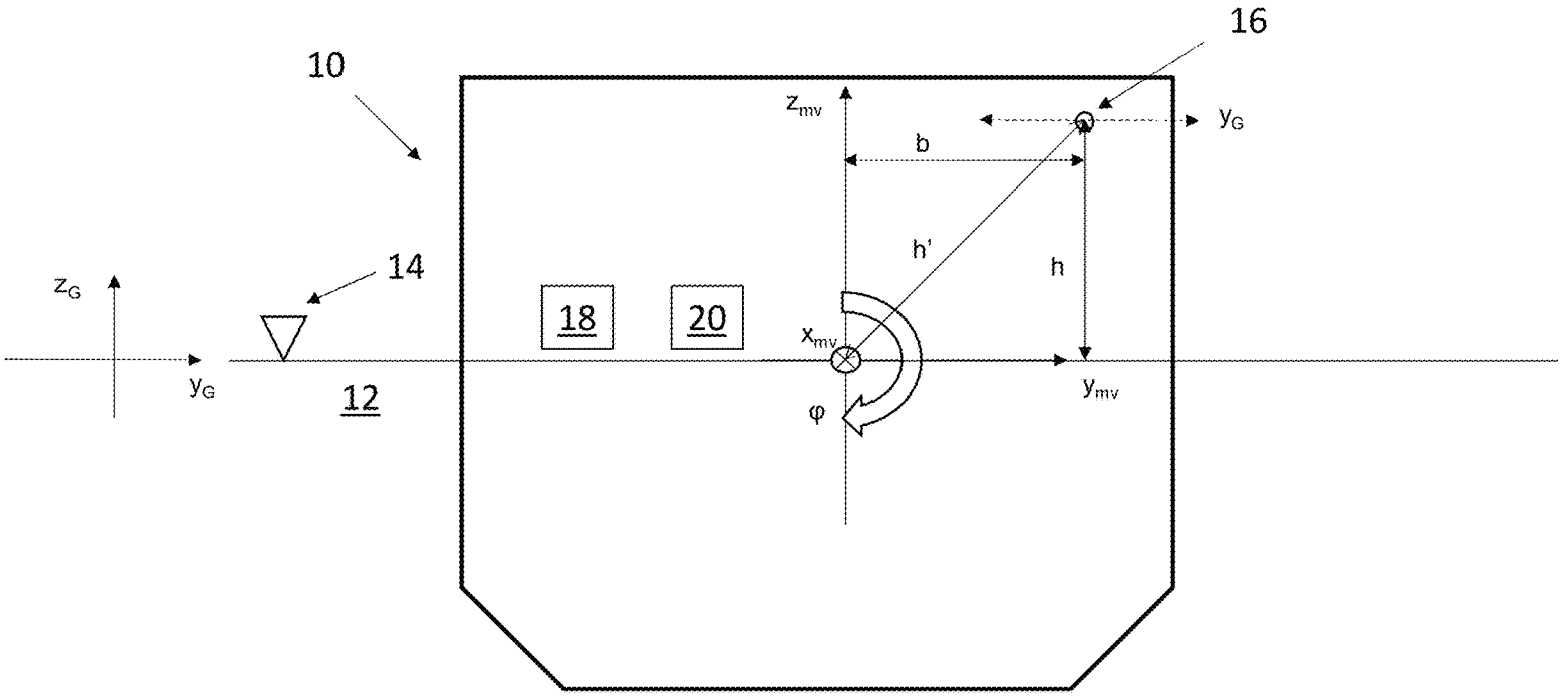
FIG. 4 is an exemplary rear view of a marine vessel.

Optionally in some examples, including in at least one preferred example, the first reference axis may be perpendicular to the marine vessel vertical axis $z_{mv}$. To this end reference is made to FIG. 4, illustrating a view from the rear of a marine vessel 10. As indicated in FIG. 4, the method may comprise determining a vertical position h along the marine vessel vertical axis $z_{mv}$ of the translational movement sensor 16 using the time-varying rotational movement signal and the time-varying translational movement signal.

In particular, and as indicated in FIG. 4, the method may comprise determining the vertical position h along the marine vessel vertical axis $z_{mv}$ of the translational movement sensor 16 using the frequency dependent rotational movement information and the frequency dependent translational movement information.

In the FIG. 4 example, the first reference axis is the marine vessel longitudinal axis $x_{mv}$. As such, in the FIG. 4 example, the rotational movement of the marine vessel 10 around the first reference axis is the roll φ. Moreover, in the FIG. 4 example, the translational movement sensor 16 may detect a movement along the global transversal axis $y_G$.

However, it is also envisaged that in other examples, the first reference axis may be the marine vessel transversal axis $y_{mv}$ such that the rotational movement of the marine vessel 10 around the first reference axis may be the pitch θ. In such an example, the translational movement sensor 16 may detect a movement along the global longitudinal axis $x_G$.

As may be realized from FIG. 4, when the marine vessel 10 is imparted a roll motion, for instance a periodic roll motion that may be induced by environmental loads such as wave loads and/or internal loads such as an inclining moment achieved by moving loads onboard the marine vessel 10, the translational movement sensor 16 may be subjected to a movement along the global transversal axis $y_G$. Assuming that the sway motion, viz the displacement along the marine vessel transversal axis $y_{mv}$, of the marine vessel 10 is negligible at least for the reference frequency, the movement of the translational movement sensor 16 along the global transversal axis $y_G$ will be dependent on the roll motion and the distance h' from the marine vessel longitudinal axis $x_{mv}$ to the translational movement sensor 16.

As indicated in FIG. 4, the distance h' from the marine vessel longitudinal axis $x_{mv}$ to the translational movement sensor 16 may be dependent on a transversal distance b from the marine vessel longitudinal axis $x_{mv}$ to the translational movement sensor 16 along the marine vessel transversal axis $y_{mv}$ as well as a vertical distance h from the marine vessel longitudinal axis $x_{mv}$ to the translational movement sensor 16 along the marine vessel vertical axis $z_{mv}$. Purely by way of example, the transversal distance b may be known or determined in accordance with e.g. the examples presented in relation to FIG. 6 hereinbelow.

The method of the present disclosure may comprise receiving a time-varying rotational movement signal from a rotational movement sensor 20 of the marine vessel 10. Again, in the FIG. 4 example, the time-varying rotational movement signal may be related to a roll motion of the marine vessel 10. A reference frequency rotational movement information indicative of the roll movement of the marine vessel 10 around the first reference axis, the marine vessel longitudinal axis $x_{mv}$ in the FIG. 4 example, for a reference frequency may be determined. Purely by way of example, the reference frequency rotational movement and the reference frequency may be determined in accordance with any one of the above examples that have been presented in relation to FIG. 2*a*-FIG. 3*d*. As such, though purely by way of example, a roll amplitude $A_\varphi$ and a reference frequency $f_{ref}$ associated with the roll amplitude $A_\varphi$ may be determined.

As a nonlimiting example, the reference frequency $f_{ref}$ may be determined in accordance with the procedure that has been presented hereinabove with reference to FIG. 3*b*, namely that the reference frequency $f_{ref}$ is associated with the largest rotational movement amplitude in the set of rotational movement amplitudes.

Moreover, the method of the present disclosure may comprise receiving a time-varying translational movement signal from the translational movement sensor 16. Again, in the FIG. 4 example, the time-varying translational movement signal may be related to a movement of the translational movement sensor 16 along the global transversal axis $y_G$. The time-varying translational movement signal may be used for determining reference frequency translational movement information indicative of the translational movement of the translational movement sensor 16 along the second reference axis, which is the global transversal axis $y_G$ in the FIG. 4 example, for the reference frequency $f_{ref}$. Purely by way of example, the reference frequency translational movement information may be determined in accordance with any one of the above examples that have been presented in relation to FIG. 2*a*-FIG. 3*d*. As such, though purely by way of example, with reference to the above examples that have been presented in relation to each one of FIG. 2*d* and FIG. 3*d*, the reference frequency translational movement information may comprise the amplitude $A_y$ for the movement of the translational movement sensor 16 along the global transversal axis $y_G$ for the reference frequency $f_{ref}$.

Figure 5:
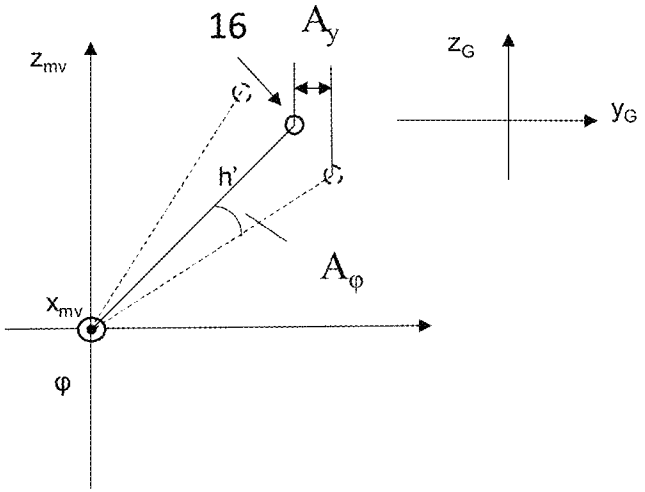
FIG. 5 schematically illustrates movements of a sensor.

FIG. 5, illustrates the movement of the translational movement sensor 16 when the marine vessel 10 is imparted a roll motion with a roll amplitude $A_\varphi$ for a reference frequency. As indicated in FIG. 5, the translational movement sensor 16 will be displaced along the global transversal axis $y_G$ for the reference frequency $f_{ref}$ with an amplitude $A_y$.

On the basis of the roll amplitude $A_\varphi$ and the amplitude $A_y$ of the translational movement sensor 16 along the global transversal axis $y_G$, it is possible to determine the distance h' from the marine vessel longitudinal axis $x_{mv}$ to the translational movement sensor 16. Purely by way of example, the distance h' may be determined in accordance with the following:

$$h' = \sqrt{\frac{4A_y^2 * \sin^2(90° - A_\varphi)}{\sin^2(2A_\varphi)} + b^2} \quad \text{Eq. 1}$$

In some examples where the roll motion is relatively small, resulting in that the transversal distance b is significantly smaller compared to the vertical distance h, for instance, the transversal distance b is around 10% of the vertical distance h, the distance h' may be determined in accordance with the following simplified equation:

$$h' = \frac{A_y}{\sin(A_\varphi)} \quad \text{Eq. 2}$$

Once the distance h' is determined, again assuming that the transversal distance b is known, it is possible to determine the vertical distance h from the marine vessel longitudinal axis $x_{mv}$ to the translational movement sensor 16 along the marine vessel vertical axis $z_{mv}$ in accordance with the following:

$$h = \sqrt{(h')^2 - b^2} \quad \text{Eq. 3}$$

It shall be noted that if using Eq. 1 to determine the distance h' from the marine vessel longitudinal axis $x_{mv}$ to the translational movement sensor 16 and inserting Eq. 1 into Eq. 3, it is possible to determine the vertical distance h without using the transversal distance b.

Although the above example has used the displacement of the translational movement sensor 16 and the magnitude of the roll motion, it should be noted that in other examples, a speed or an acceleration of the translational movement sensor 16 may be used instead. In a similar vein, a roll rate and or a roll acceleration may be used instead of the roll motion.

Figure 6:
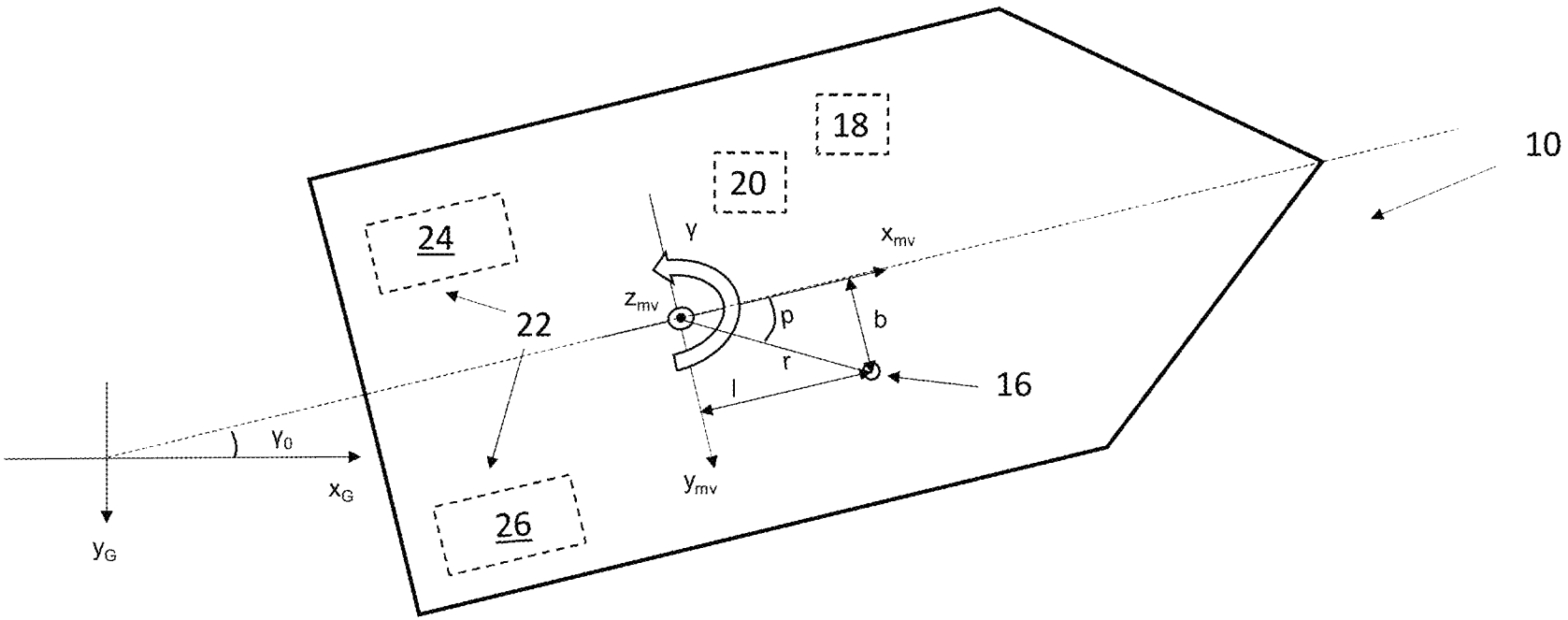
FIG. 6 is an exemplary top view of a marine vessel.

Optionally in some examples, including in at least one preferred example, the first reference axis is parallel to the marine vessel vertical axis $z_{mv}$. To this end, reference is made to FIG. 6 illustrating a top view of a marine vessel 10. As indicated in FIG. 6, there is a transversal distance b from the marine vessel longitudinal axis $x_{mv}$, to the translational movement sensor 16 along the marine vessel transversal axis $y_{mv}$ as well as a longitudinal distance 1 from the marine vessel transversal axis $y_{mv}$ to the translational movement sensor 16 along the marine vessel longitudinal axis $x_{mv}$. The above-mentioned transversal distance b and the longitudinal distance 1 together result in a horizontal distance r from the marine vessel vertical axis $z_{mv}$ to the translational movement sensor 16.

Moreover, as indicated in FIG. 6, the marine vessel 10 comprises a propulsion assembly 22 adapted to propel the marine vessel 10. In the FIG. 6 example, the propulsion assembly 22 comprises two propulsion units 24, 26. As non-limiting examples, each one of the two propulsion units may comprise an outboard motor, a drive connected to an inboard motor (not shown) or the like. In some other examples, the propulsion assembly 22 may comprise a bow thruster and/or a stern thruster. Irrespective of the implementation of the propulsion assembly 22, the method may comprise issuing a signal to the propulsion system 22 of the marine vessel 10 to perform a rotational movement. Purely by way of example, the method may comprise issuing signals to the two propulsion units 24, 26 to produce a thrust with same magnitude but in opposite direction. For instance, the propulsion assembly 22 may be operated so as to impart a yaw movement of the marine vessel 10, i.e. a rotation around the marine vessel vertical axis $z_{mv}$.

In some examples, the rotational movement may not be performed by the propulsion assembly 22. For instance, a rotational movement may be created by introducing one or more vertical forces at different positions of the marine vessel 10. For instance, a weight (not shown) may be moved to different positions of the marine vessel 10, for instance to different positions located on opposite sides of the vessel longitudinal axis $x_{mv}$, such that a roll motion is achieved. As another non-limiting example, a rotational movement, such as a roll motion or a pitch motion may be achieved by environmental loads, such as wave loads, which are imparted on the marine vessel 10.

Again with reference to FIG. 6, in some examples, including in at least one preferred example, the time-varying rotational movement signal may comprise information about a rotation rate of the rotational movement of the marine vessel 10 around the first reference axis of the marine vessel 10. As such, in the FIG. 6 example, the time-varying rotational movement signal may comprise the yaw rate of the marine vessel 10. The yaw rate is hereinafter referred to as ω whereby ω=dy/dt.

Furthermore, the method may comprise using the time-varying rotational movement signal for determining reference frequency rotational movement information indicative of said rotational movement of said marine vessel around the first reference axis for a reference frequency. In the present example, the method may determine a frequency at which the above-mentioned yaw rate is high. Purely by way of example, the frequency dependent rotational movement information for the FIG. 6 example may comprise a set of yaw rate amplitudes, each yaw rate amplitude being associated with an individual frequency. Moreover, the method may comprise determining a reference frequency $f_{ref}$ associated with the largest yaw rate amplitude in the set of yaw rate amplitudes.

Moreover, the time-varying translational movement signal may be used for determining reference frequency translational movement information indicative of the translational movement of the translational movement sensor 16 along the second reference axis, which for instance may be the global longitudinal axis $x_G$, for the reference frequency $f_{ref}$.

To this end, using a speed of the translational movement sensor 16 in the global longitudinal axis $x_G$ as an example, the amplitude of the speed in the longitudinal axis $x_G$ of the translational movement sensor 16 may be determined as $A_{xG}$. As a non-limiting example, the amplitude $A_{xG}$ of the speed in the global longitudinal axis $x_G$ of the translational movement sensor 16 may be determined using the above-mentioned reference frequency $f_{ref}$ associated with the largest yaw rate amplitude. Again, as non-limiting examples, the amplitude $A_{xG}$ may be determined in accordance with any one of the examples presented hereinabove with reference to each one of FIG. 2*d* and FIG. 3*d*.

Figure 7B:
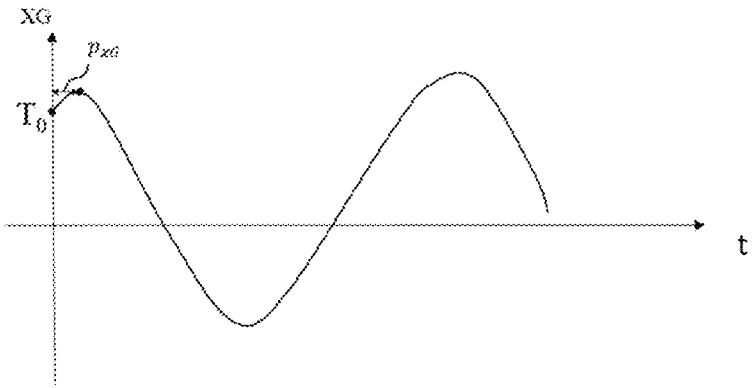
FIGS. 7*a*-7*b* illustrate time-varying movement signals and reference frequency information according to another example.
Figure 7A:
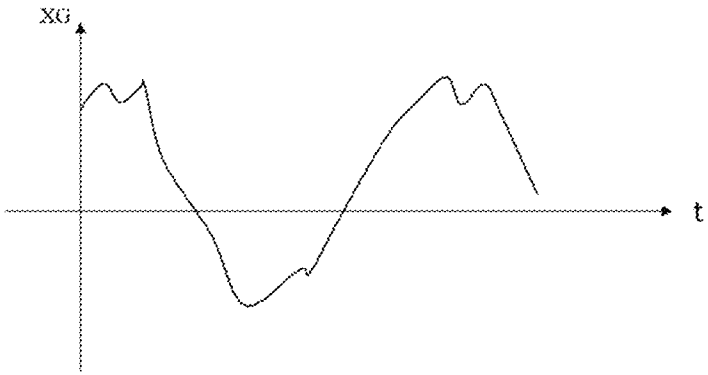

Moreover, the time-varying rotational movement signal may comprise an initial position $\gamma_0$, viz a detected yaw position (or a heading) at the beginning of the time-varying rotational movement signal. It shall be noted that if the marine vessel longitudinal axis $x_{mv}$ overlaps or is parallel with the global longitudinal axis $x_G$, at the beginning of the time-varying rotational movement signal, the initial position $\gamma_0$ may be zero. Additionally, an angle p between the translational movement sensor 16 and the marine vessel vertical axis $z_{mv}$ along the marine vessel longitudinal axis $x_{mv}$ may be determined using the information of the time-varying translational movement signal, for instance, a translational movement of the translational movement sensor 16 along the global longitudinal axis $x_G$ as a function of time, which is illustrated in FIG. 7*a*. FIG. 7*b* subsequently shows a frequency translational movement information has been obtained by filtering the FIG. 7*a* time-varying translational movement signal such that only motions relating to the reference frequency remain after the filtering. As such, an offset $p_{XG}$, corresponding to a time difference between the starting point $T_0$ of the time-varying rotational movement signal, and the peak of the reference frequency is obtained. The offset $p_{XG}$ may thereafter be converted to a corresponding angle.

The above-mentioned angle p between the translational movement sensor 16 and the marine vessel vertical axis $z_{mv}$ along the marine vessel longitudinal axis $x_m$ may therefore be determined in accordance with the following:

$$p = (90° + \gamma_0 - p_{XG}) \quad \text{Eq. 4}$$

Using the above information, the method may comprises determining a transversal position b along the marine vessel transversal axis $y_{mv}$ and/or a longitudinal position 1 along the marine vessel longitudinal axis $x_{mv}$ of the translational movement sensor 16 using the time-varying rotational movement signal and the time-varying translational movement signal.

For instance, the transversal position b and the longitudinal position 1, respectively, may be determined using the reference frequency rotational movement information, such as the reference frequency $f_{ref}$ associated with the largest yaw rate amplitude in the set of yaw rate amplitudes as well as the largest yaw rate ω as such, as well as amplitude $A_{xG}$ of the speed in the global longitudinal axis $x_G$ of the translational movement sensor 16 may be determined using the above-mentioned reference frequency $f_{ref}$ along the marine vessel longitudinal axis $x_{mv}$ of the translational movement sensor 16 Purely by way of example, the above-mentioned transversal distance b and the longitudinal distance 1 may be determined in accordance with the following:

$$b = \frac{A_{xG}}{\omega} \cdot \sin(p) \quad \text{Eq. 5}$$

$$l = \frac{A_{xG}}{\omega} \cdot \cos(p) \quad \text{Eq. 6}$$

It should be noted that although the above procedure for determining the transversal position b and/or the longitudinal position 1 of the translational movement sensor 16 has been exemplified as using the speed of the translational movement sensor 16 along the longitudinal axis $x_G$, it is envisaged that other examples of the method may instead, or in addition to using the speed along the longitudinal axis $x_G$, use the speed of the translational movement sensor 16 along the transversal axis $y_G$.

Moreover, the present disclosure may be exemplified by any one of the below examples.

Example 1: a computer system comprising a processing circuitry configured to determine information indicative of a position of a translational movement sensor 16 on a marine vessel 10, said marine vessel 10 extending in a longitudinal direction along a marine vessel longitudinal axis $x_{mv}$, said longitudinal direction preferably corresponding to an intended direction of travel of said marine vessel 10, said marine vessel 10 extending in a vertical direction along a marine vessel vertical axis $z_{mv}$ and in a transversal direction along a marine vessel transversal axis $y_{mv}$, wherein said transversal axis $y_{mv}$ is perpendicular to each one of said longitudinal axis $x_{mv}$ and said vertical axis $z_{mv}$, said computer system being adapted to:

- receive a time-varying rotational movement signal from a rotational movement sensor of said marine vessel 10, said time-varying rotational movement signal relating to a rotational movement of said marine vessel 10 around a first reference axis as a function of time for a first time range $\Delta T_1$;
- receive a time-varying translational movement signal from said translational movement sensor 16, said time-varying rotational movement signal relating to a translational movement of said translational movement sensor 16 along a second reference axis as a function of time for a second time range $\Delta T_2$, said first reference axis being nonparallel to said second reference axis;
- use the time-varying rotational movement signal for determining reference frequency-rotational movement information indicative of said rotational movement of said marine vessel 10 around said first reference axis for a reference frequency;
- use the time-varying translational movement signal for determining reference frequency translational movement information indicative of said translational movement of said translational movement sensor 16 along said second reference axis for said reference frequency;
- use said reference frequency rotational movement information and said reference frequency translational movement information for determining said information indicative of said position of said translational movement sensor 16 on a marine vessel 10.

Example 2: a computer-implemented method for determining information indicative of a position of a translational movement sensor 16 on a marine vessel 10 by a processing circuitry of a computer system, said marine vessel 10 extending in a longitudinal direction along a marine vessel longitudinal axis $x_{mv}$, said longitudinal direction preferably corresponding to an intended direction of travel of said marine vessel 10, said marine vessel 10 extending in a vertical direction along a marine vessel vertical axis $z_{mv}$ and in a transversal direction along a marine vessel transversal axis $y_{mv}$, wherein said transversal axis $y_{mv}$ is perpendicular to each one of said longitudinal axis $x_{mv}$ and said vertical axis $z_{mv}$, the method comprising:

receiving, by the processing circuitry, a time-varying rotational movement signal from a rotational movement sensor 20 of said marine vessel 10, said time-varying rotational movement signal relating to a rotational movement of said marine vessel 10 around a first reference axis as a function of time for a first time range $\Delta T_1$;

receiving, by the processing circuitry, a time-varying translational movement signal from said translational movement sensor 16, said time-varying rotational movement signal relating to a translational movement of said translational movement sensor 16 along a second reference axis as a function of time for a second time range $\Delta T_2$, said first reference axis being nonparallel to said second reference axis;

using, by the processing circuitry, the time-varying rotational movement signal for determining reference frequency rotational movement information indicative of said rotational movement of said marine vessel 10 around said first reference axis for a reference frequency;

using, by the processing circuitry, the time-varying translational movement signal for determining reference frequency translational movement information indicative of said translational movement of said translational movement sensor 16 along said second reference axis for said reference frequency;

using, by the processing circuitry, said reference frequency rotational movement information and said reference frequency translational movement information for determining said information indicative of said position of said translational movement sensor 16 on said marine vessel 10.

Example 3: The method according to Example 2, wherein said second reference axis is fixed in a global reference coordinate system, said global reference coordinate system comprising a global longitudinal axis $x_G$, a global transversal axis $y_G$ and a global vertical axis $z_G$, said global reference coordinate system being such that when said marine vessel 10 floats at calm sea with zero trim and tilt, said global vertical axis $z_G$ is parallel to said marine vessel vertical axis $z_{mv}$, said global reference coordinate system being fixed to an entity separate from said marine vessel 10, preferably said global reference coordinate system being earth fixed.

Example 4: The method according to any one of Examples 2-3, wherein using the time-varying rotational movement signal for determining reference frequency rotational movement information indicative of said rotational movement of said marine vessel 10 around said first reference axis for a reference frequency comprises transferring the time-varying rotational movement signal to the frequency domain in order to obtain frequency dependent rotational movement information.

Example 5: The method according to any one of Examples 2-4, wherein using the time-varying translational movement signal for determining reference frequency translational movement information indicative of said translational movement of said translational movement sensor 16 along said second reference axis for said reference frequency comprising transferring the time-varying rotational movement signal to the frequency domain in order to obtain frequency dependent translational movement information.

Example 6: The method according to any one of Examples 2-5, wherein said second reference axis is perpendicular to said first reference axis.

Example 7: The method according to any one of Examples 2-6, wherein said first reference axis is perpendicular to the marine vessel vertical axis $z_{mv}$.

Example 8: The method according to Example 6 and Example 7, wherein the method further comprises determining a vertical position along said marine vessel vertical axis $z_{mv}$ of the translational movement sensor (16) using said time-varying rotational movement signal and said time-varying translational movement signal.

Example 9: The method according to Example 4, Example 5 and Example 8, wherein the method further comprises determining said vertical position along said marine vessel vertical axis $z_{mv}$ of the translational movement sensor 16 using said frequency dependent rotational movement information and said frequency dependent translational movement information.

Example 10: The method according to Example 9, wherein said frequency dependent rotational movement information comprises a set of rotational movement amplitudes, each rotational movement amplitude being associated with an individual frequency, said method comprising determining a reference frequency associated with the largest rotational movement amplitude in said set of rotational movement amplitudes and to determine a translational movement amplitude for said reference frequency using said frequency dependent translational movement information.

Example 11: The method according to any one of Examples 2-6, wherein said first reference axis is parallel to the marine vessel vertical axis $z_{mv}$.

Example 12: The method according to example 11, wherein the time-varying rotational movement signal comprises information about a rotation rate of the rotational movement of said marine vessel 10 around the first reference axis of the marine vessel.

Example 13: The method according to Example 3 and any one of Example 11-12, wherein the time-varying translational movement signal comprises information about velocity along said second reference axis, preferably said second reference axis being parallel to said global longitudinal axis $x_G$ or to said global transversal axis $y_G$.

Example 14: The method according to Example 13, wherein the method further comprises determining a transversal position along said marine vessel transversal axis $y_{mv}$ and/or a longitudinal position along said marine vessel longitudinal axis $x_{mv}$ of said translational movement sensor 16 using said time-varying rotational movement signal and said time-varying translational movement signal.

Example 15: The method according to Example 4, Example 5 and Example 14, wherein the method further comprising determining said transversal position along said marine vessel transversal axis $y_{mv}$ and/or a longitudinal position along said marine vessel longitudinal axis $x_{mv}$ of the translational movement sensor 16 using said frequency dependent rotational movement information and said frequency dependent translational movement information.

Example 16: The method according to Example 15, wherein said frequency dependent rotational movement information comprises a set of rotation rate amplitudes, each rotation rate amplitude being associated with an individual frequency, said method comprising determining a reference frequency associated with the largest rotation rate amplitude in said set of rotation rate amplitudes and to determine an amplitude for said velocity along said second reference axis for said reference frequency using said frequency dependent translational movement information.

Example 17: The method according to any one of Examples 2-16, wherein said marine vessel 10 has a propulsion system 22, the method further comprising:

issuing a signal to the propulsion system of the marine vessel 10 to perform a rotational movement.

Example 18: The method according to any one of Examples 2-17, wherein said first time range $\Delta T_1$ is adjacent to or at least partially overlaps said second time range $\Delta T_2$.

Example 19: A computer program product comprising program code for performing, when executed by the processing circuitry, the method of any of examples 2-18.

Example 20: A non-transitory computer-readable storage medium comprising instructions, which when executed by the processing circuitry, cause the processing circuitry to perform the method of any of examples 2-18.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A computer system comprising a processing circuitry configured to determine information indicative of a position of a translational movement sensor on a marine vessel, said marine vessel extending in a longitudinal direction along a marine vessel longitudinal axis, said longitudinal direction preferably corresponding to an intended direction of travel of said marine vessel, said marine vessel extending in a vertical direction along a marine vessel vertical axis and in a transversal direction along a marine vessel transversal axis, wherein said transversal axis is perpendicular to each one of said longitudinal axis and said vertical axis, said computer system being adapted to:

receive a time-varying rotational movement signal from a rotational movement sensor of said marine vessel, said time-varying rotational movement signal relating to a rotational movement of said marine vessel around a first reference axis as a function of time for a first time range;

receive a time-varying translational movement signal from said translational movement sensor, said time-varying rotational movement signal relating to a translational movement of said translational movement sensor along a second reference axis as a function of time for a second time range, said first reference axis being nonparallel to said second reference axis;

use the time-varying rotational movement signal for determining reference frequency rotational movement information indicative of said rotational movement of said marine vessel around said first reference axis for a reference frequency;

use the time-varying translational movement signal for determining reference frequency translational movement information indicative of said translational movement of said translational movement sensor along said second reference axis for said reference frequency;

use said reference frequency rotational movement information and said reference frequency translational movement information for determining said information indicative of said position of said translational movement sensor on a marine vessel, wherein said marine vessel has a propulsion system, the method further comprising:

issuing a signal to the propulsion system of the marine vessel to perform a rotational movement.

2. A computer-implemented method for determining information indicative of a position of a translational movement sensor on a marine vessel by a processing circuitry of a computer system, said marine vessel extending in a longitudinal direction along a marine vessel longitudinal axis, said longitudinal direction preferably corresponding to an intended direction of travel of said marine vessel, said marine vessel extending in a vertical direction along a marine vessel vertical axis and in a transversal direction along a marine vessel transversal axis, wherein said transversal axis is perpendicular to each one of said longitudinal axis and said vertical axis, the method comprising:

receiving, by the processing circuitry, a time-varying rotational movement signal from a rotational movement sensor of said marine vessel, said time-varying rotational movement signal relating to a rotational movement of said marine vessel around a first reference axis as a function of time for a first time range;

receiving, by the processing circuitry, a time-varying translational movement signal from said translational movement sensor, said time-varying rotational movement signal relating to a translational movement of said translational movement sensor along a second reference axis as a function of time for a second time range, said first reference axis being nonparallel to said second reference axis;

using, by the processing circuitry, the time-varying rotational movement signal for determining reference frequency rotational movement information indicative of said rotational movement of said marine vessel around said first reference axis for a reference frequency;

using, by the processing circuitry, the time-varying translational movement signal for determining reference frequency translational movement information indicative of said translational movement of said translational movement sensor along said second reference axis for said reference frequency;

using, by the processing circuitry, said reference frequency rotational movement information and said reference frequency translational movement information for determining said information indicative of said position of said translational movement sensor on said marine vessel, wherein said marine vessel has a propulsion system, the method further comprising:

issuing a signal to the propulsion system of the marine vessel to perform a rotational movement.

3. The method according to claim 2, wherein said second reference axis is fixed in a global reference coordinate system, said global reference coordinate system comprising a global longitudinal axis, a global transversal axis and a global vertical axis, said global reference coordinate system being such that when said marine vessel floats at calm sea with zero trim and tilt, said global vertical axis is parallel to said marine vessel vertical axis, said global reference coordinate system being fixed to an entity separate from said marine vessel, preferably said global reference coordinate system being earth fixed.

4. The method according to claim 2, wherein using the time-varying rotational movement signal for determining reference frequency rotational movement information indicative of said rotational movement of said marine vessel around said first reference axis for a reference frequency comprises transferring the time-varying rotational movement signal to the frequency domain in order to obtain frequency dependent rotational movement information.

5. The method according to claim 2, wherein using the time-varying translational movement signal for determining reference frequency translational movement information indicative of said translational movement of said translational movement sensor along said second reference axis for said reference frequency comprising transferring the time-varying rotational movement signal to the frequency domain in order to obtain frequency dependent translational movement information.

6. The method according to claim 2, wherein said second reference axis is perpendicular to said first reference axis.

7. The method according to claim 2, wherein said first reference axis is perpendicular to the marine vessel vertical axis.

8. The method according to claim 7, wherein the method further comprises determining a vertical position along said marine vessel vertical axis of the translational movement sensor using said time-varying rotational movement signal and said time-varying translational movement signal.

9. The method according to claim 8, wherein the method further comprises determining said vertical position along said marine vessel vertical axis of the translational movement sensor using said frequency dependent rotational movement information and said frequency dependent translational movement information, preferably said frequency dependent rotational movement information comprises a set of rotational movement amplitudes, each rotational movement amplitude being associated with an individual frequency, said method comprising determining a reference frequency associated with the largest rotational movement amplitude in said set of rotational movement amplitudes and to determine a translational movement amplitude for said reference frequency using said frequency dependent translational movement information.

10. The method according to claim 2, wherein said first reference axis is parallel to the marine vessel vertical axis, preferably said time-varying rotational movement signal comprises information about a rotation rate of the rotational movement of said marine vessel around the first reference axis of the marine vessel.

11. The method according to claim 10, wherein the time-varying translational movement signal comprises information about velocity along said second reference axis, preferably said second reference axis being parallel to said global longitudinal axis or to said global transversal axis.

12. The method according to claim 11, wherein the method further comprises determining a transversal position along said marine vessel transversal axis and/or a longitudinal position along said marine vessel longitudinal axis of said translational movement sensor using said time-varying rotational movement signal and said time-varying translational movement signal.

13. The method according to claim 12, wherein the method further comprising determining said transversal position along said marine vessel transversal axis and/or a longitudinal position along said marine vessel longitudinal axis of the translational movement sensor using said frequency dependent rotational movement information and said frequency dependent translational movement information, preferably said frequency dependent rotational movement information comprises a set of rotation rate amplitudes, each rotation rate amplitude being associated with an individual frequency, said method comprising determining a reference frequency associated with the largest rotation rate amplitude in said set of rotation rate amplitudes and to determine an amplitude for said velocity along said second reference axis for said reference frequency using said frequency dependent translational movement information.

14. The method according to claim 2, wherein said first time range is adjacent to or at least partially overlaps said second time range.

* * * * *